US007290666B2

(12) United States Patent
Yuito

(10) Patent No.: US 7,290,666 B2
(45) Date of Patent: Nov. 6, 2007

(54) METHOD AND APPARATUS FOR SORTING ARTICLE

(75) Inventor: Fumio Yuito, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/935,089

(22) Filed: Sep. 8, 2004

(65) Prior Publication Data

US 2005/0067328 A1 Mar. 31, 2005

(30) Foreign Application Priority Data

Sep. 9, 2003 (JP) ..... 2003-316267

(51) Int. Cl.
*B07C 5/00* (2006.01)

(52) U.S. Cl. ..... 209/551; 209/576; 209/589; 209/922; 700/223

(58) Field of Classification Search ..... 209/551, 209/922, 576, 589
See application file for complete search history.

(56) References Cited

U.S. PATENT DOCUMENTS 4,130,480 A * 12/1978 Loewenthal ..... 209/551
4,884,696 A * 12/1989 Peleg ..... 209/545
4,953,841 A * 9/1990 Polarek ..... 270/52.02
5,139,150 A * 8/1992 Fuller et al. ..... 209/576
5,193,685 A * 3/1993 Trevithick ..... 209/3.1
5,615,395 A * 3/1997 Komaki et al. ..... 396/6
6,052,884 A * 4/2000 Steckler et al. ..... 29/407.08
6,434,341 B1 * 8/2002 Tominaga ..... 396/429
6,471,039 B1 * 10/2002 Bruun et al. ..... 198/577
6,789,660 B1 * 9/2004 Bruun et al. ..... 198/347.1
6,923,307 B2 * 8/2005 Haan et al. ..... 198/347.4

FOREIGN PATENT DOCUMENTS

JP 6-160048 A 6/1994
JP 6-161042 A 6/1994
JP 8-282837 A 10/1996
JP 11-20937 A 1/1999
JP 2000-140771 A 5/2000
JP 2000-142962 A 5/2000

* cited by examiner

*Primary Examiner*—Patrick Mackey
*Assistant Examiner*—Terrell Matthews
(74) *Attorney, Agent, or Firm*—Sughrue Mion, PLLC

(57) ABSTRACT

Used articles of different types are sorted into individual types through a sorting line, and are feed to disassembling lines that are provided for the respective article types. The sorting line is provided with a type discriminating section and a sorting section. In the sorting section, a number of sorting mechanisms are provided for the respective article types, and are arranged sequentially along a conveying direction of the articles. The individual sorting mechanism sorts out articles of a designated type on the basis of discrimination data from the type discriminating section. A controller counts the number of discriminated articles separately from type to type, and controls the sorting mechanisms depending upon the count of each type, to feed the sorted articles either to a corresponding one of the disassembling lines through a respective supply line, or to a buffer section.

22 Claims, 10 Drawing Sheets

FIG.11

| FILM UNIT | TYPE | BATTERY | PHOTOGRAPHED SIDE | DISCRIMINATION RESULT CODE |
|---|---|---|---|---|
| 1 | TYPE I (10) | WITH (1) | FRONT (3) | 1013 |
| 2 | TYPE II (11) | WITHOUT (2) | REAR (4) | 1124 |
| 3 | TYPE III (12) | WITH (1) | FRONT (3) | 1213 |
| 4 | TYPE II (11) | WITHOUT (2) | REAR (4) | 1124 |
| ⋮ | ⋮ | ⋮ | ⋮ | ⋮ |

METHOD AND APPARATUS FOR SORTING ARTICLE

FIELD OF THE INVENTION

The present invention relates to a method of sorting articles according to their types, especially used industrial articles for the purpose of recycling them. The present invention relates also to a sorting apparatus for this method.

BACKGROUND ARTS

In terms of environmental protection or industrial waste reduction, an increasing number of industrial articles are recycled. Recycling can roughly be classified into reproductive use and reuse. For the reproductive use, respective parts of articles are sorted according to their materials, and reproduced as raw materials. On the other hand, the reuse is using some parts of articles as the same parts of newly produced articles.

As for lens-fitted photo film units, hereinafter called briefly film units, their bodies are collected after the exposed photo filmstrips are removed, and are disassembled through automatic disassembling lines. Functional parts of the disassembled film units, such as exposure units and flash units, are reused, and other plastic parts, such as front and rear covers, are reproduced as raw materials, as disclosed for example in Japanese Laid-open Patent Application No. 6-161042.

As well-known in the art, there are a variety of types of film units which are different from each other in external shape and in internal structure. So the automatic disassembling lines are installed for the respective film unit types. Collected used film units are to be sorted out according to their types, before being fed to the corresponding disassembling lines.

Since the film units have their essential components, like a photographic lens and a flash emitting portion, disposed on its front side, different types have different appearances, especially on the front sides. For this reason, conventional sorting apparatuses discriminate between the different types of film units by photographing the appearances of the film units as they are conveyed in a designated posture. Image data obtained by photographing each film unit are compared to reference image data that are prepared for the respective film unit types, so that the film unit type is discriminated depending upon the results of comparison. Such automatic sorting apparatuses are disclosed in Japanese Laid-open Patent Applications Nos. Hei 6-160048, Hei 8-282837, and 2000-142962.

However, there are those types of film units whose appearances can only be discriminated from other types either on the front sides or on the rear sides. For those film units, the above mentioned prior art sorting apparatuses cannot discriminate the types unless the film units are aligned to direct their discriminative sides toward the camera. Therefore, in order to make the sorting of the film units fully automatically, it is necessary to discriminate between the front side and the rear side of each article, and turn over some of the articles to align them into the designated posture and orientation, before feeding them to the photography station. Because of the need for the side discrimination and posture alignment, the sorting apparatuses of the prior arts are inevitably large in size, and take relatively longer processing time.

It may be possible to prepare the reference images respectively for the front and rear sides of each individual type, so as to determine the type by comparison of a photographed image of either the front side or the rear side of each article with the front side reference images and the rear side reference images. If the different type film units always had different rear side appearances, it could be possible to discriminate the type just by photographing one side of the individual film unit regardless of whether it is front or rear. However, since there are many types of film units that have substantially the same rear side appearances, it is necessary to check the front sides for discriminating between these types.

Furthermore, because the automatic sorting apparatus of the above mentioned prior arts just sorts out the film units as they are sequentially supplied to the sorting apparatus, if the collected film units are biased toward a particular type, the sorting apparatus will feed that type of film units to a corresponding disassembling line more frequently than other types. That is, the conventional sorting apparatus cannot equally feed the film units to the respective disassembling lines. Although the sorting apparatus and the disassembling lines have some buffering functions, if the flow of particular type film units from the sorting apparatus to the corresponding disassembling line exceeds so much over the processing capacity of that disassembling line that the excess of the film units on that line cannot be absorbed by the buffering function, the sorting apparatus itself must interrupt working. This lowers efficiency of the overall recycling operations.

SUMMARY OF THE INVENTION

In view of the foregoing, a primary object of the present invention is to provide an apparatus for and a method of sorting articles, whereby articles are sorted out with high efficiency while preventing excessive supply of particular type articles to the following lines that are provided for the respective types of the articles to process.

To achieve the above and other objects in a sorting apparatus for sorting used articles according to their types wherein the articles have different appearances or internal structures from type to type, the present invention comprises a conveyer for conveying the articles of different types in a conveying direction; an imaging device for taking image data from each of the articles as being conveyed on the conveyer; a discrimination device for determining the type of each of the articles on the basis of the image data, and outputting discrimination data for each article; a sorting device disposed behind the imaging device in the conveying direction, for sorting the articles into individual types in accordance with the discrimination data; a number of supply sections for supplying the articles, after being sorted, to a number of disassembling lines which are provided for the respective types of the articles; a buffer section for storing the articles after being sorted; and a control device for controlling the sorting device such that each of the articles is fed from the sorting device through one of the supply sections to a corresponding one of the disassembling lines that is determined in accordance with the type of each article, only while the corresponding disassembling line can afford to process the article, and that each of the articles is fed from the sorting device to the buffer section when the corresponding disassembling line cannot afford to process the article.

According to a preferred embodiment, the control device counts the number of discriminated articles separately from type to type on the basis of the discrimination data, compares the count of each type per unit time with a preset number of articles processed per unit time on the corresponding disassembling line, and controls the sorting device to feed the article to the buffer section when the count per unit time is more than the preset processing number, or to the corresponding disassembling line when the count per unit time is less than the preset processing number.

According to another preferred embodiment, the control device monitors the number of the articles existing on each of the supply sections. Then, the controller controls the sorting device to feed the article to the buffer section when the corresponding supply section cannot further accept the article. When the corresponding supply section can further accept the article, the controller controls the sorting device to feed the article to the corresponding supply section.

It is preferable to provide the sorting apparatus further with a circulating device for feeding the articles from the buffer section back to the conveyer so that the articles are conveyed again through the imaging device to the sorting device.

In another preferred embodiment, the buffer section consists of a number of buffer sections for storing the articles separately from type to type, and the sorting apparatus further comprises a number of supplemental lines connecting each of the buffer sections to a corresponding one of the supply sections. In this embodiment, the controller controls each of the buffer sections to feed the article through the supplemental line to the corresponding supply section when the corresponding disassembling line can afford to process the article.

It is preferable to use an X ray imaging device for taking the image data from the articles. The X ray imaging device applies X-rays to a front side or a rear side of each of the articles to photograph a transparent image of each article. Then the discrimination device can determines the type of each article on the basis of the transparent image. Therefore, it is unnecessary to align the articles so as to direct the same side to the imaging device.

According to the present invention, a method of sorting used articles according to their types comprises the steps of:

conveying the articles of different types in a conveying direction;

taking image data from each of the articles as being conveyed;

determining the type of each of the articles on the basis of the image data, to output discrimination data for each article;

sorting the articles into individual types in accordance with the discrimination data;

monitoring the number of the articles separately from type to type, to check if each of disassembling lines, which are provided for the respective types of the articles, can afford to process the articles;

feeding each of the articles, after being sorted, to a corresponding one of the disassembling lines only while the corresponding disassembling line can afford to process the article; and feeding the articles, after being sorted, to a buffer section when the corresponding disassembling line cannot afford to process the article.

BRIEF DESCRIPTION OF THE DRAWINGS

The above and other objects and advantages will be more apparent from the following detailed description of the preferred embodiments when read in connection with the accompanied drawings, wherein like reference numerals designate like or corresponding parts throughout the several views, and wherein:

FIG. 11 is an explanatory diagram illustrating an example of discrimination data produced by the image processing and discriminating circuit.

DESCRIPTION OF THE PREFERRED EMBODIMENTS

Figure 1:
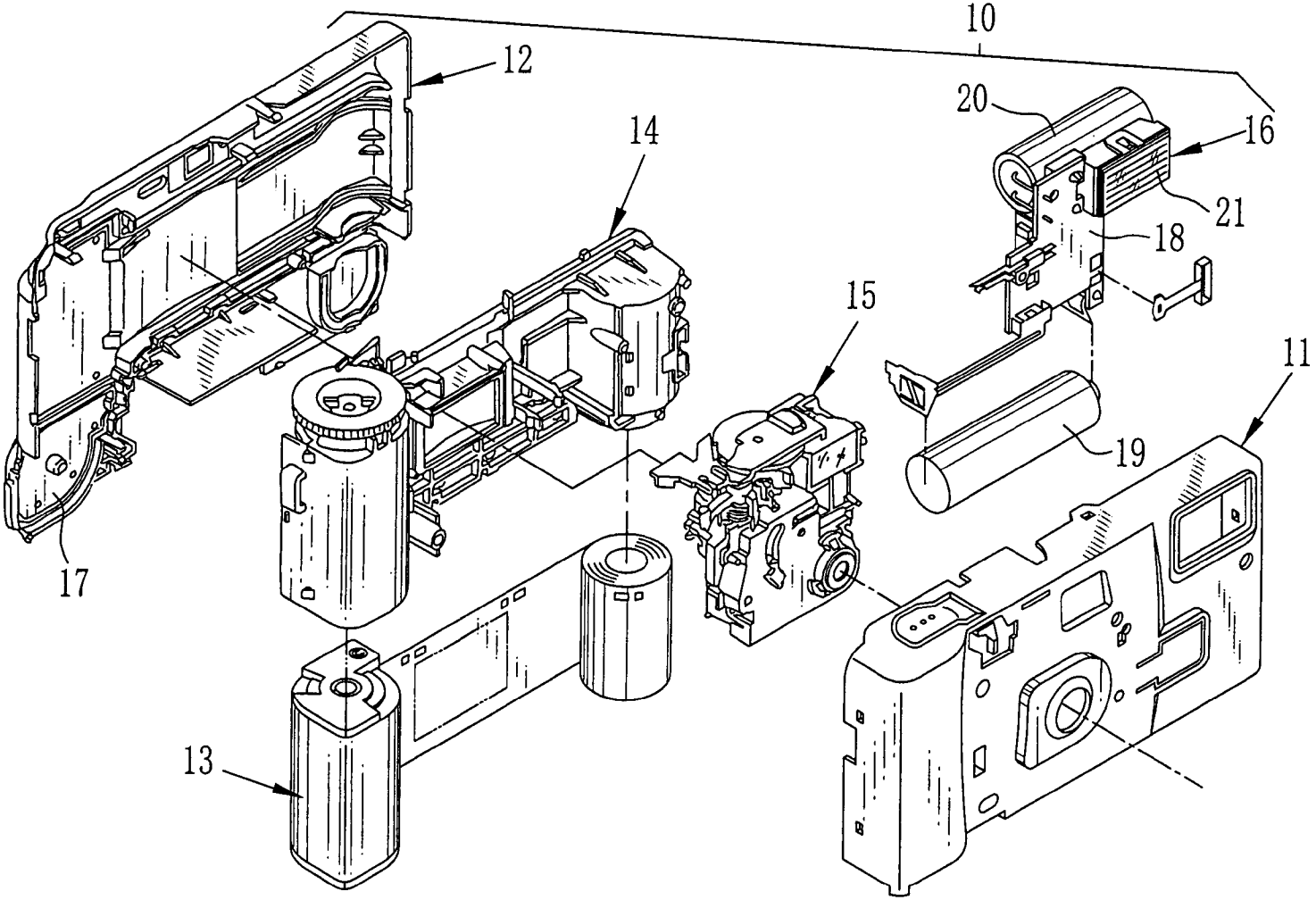
FIG. 1 is an exploded perspective view of a lens-fitted photo film unit.

As shown in FIG. 1, a film unit 10 is provided with a photo film cartridge 13, a plastic main body portion 14, an exposure unit 15 and a flash unit 16, which are contained in an outer cover consisting of plastic front and rear cover portions 11 and 12. The photo film cartridge 13 is contained light-tightly in between the main body portion 14 and the rear cover portion 12. The rear cover portion 12 has a bottom lid 17 that closes a bottom side of a cartridge chamber 14*a* of the main body portion 14, and can be opened to remove the photo film cartridge 13 after the completion of all available exposures.

The exposure unit 15 is an assembly having photographic mechanisms integrated into one body, including a photographic lens, a shutter mechanism, a film-winding and shutter-cocking mechanism and a winding-lock mechanism. Also a viewfinder optical system is integrated into the exposure unit 15. The exposure unit 15 is removably attached to a front side of the main body portion 14.

The flash unit 16 is attached to the front side of the main body portion 14 beside the exposure unit 15. The flash unit 16 includes a number of metallic components, like a copper foil circuit pattern on a circuit board 18, a power source battery 19, a main capacitor 20 and a reflector of a flash emitting portion 21. Also in the exposure unit 15, many metallic components, like springs, are used as components of the mechanisms. Thus, the film unit 10 is a complex assembly of plastic and metallic components.

Figure 2:
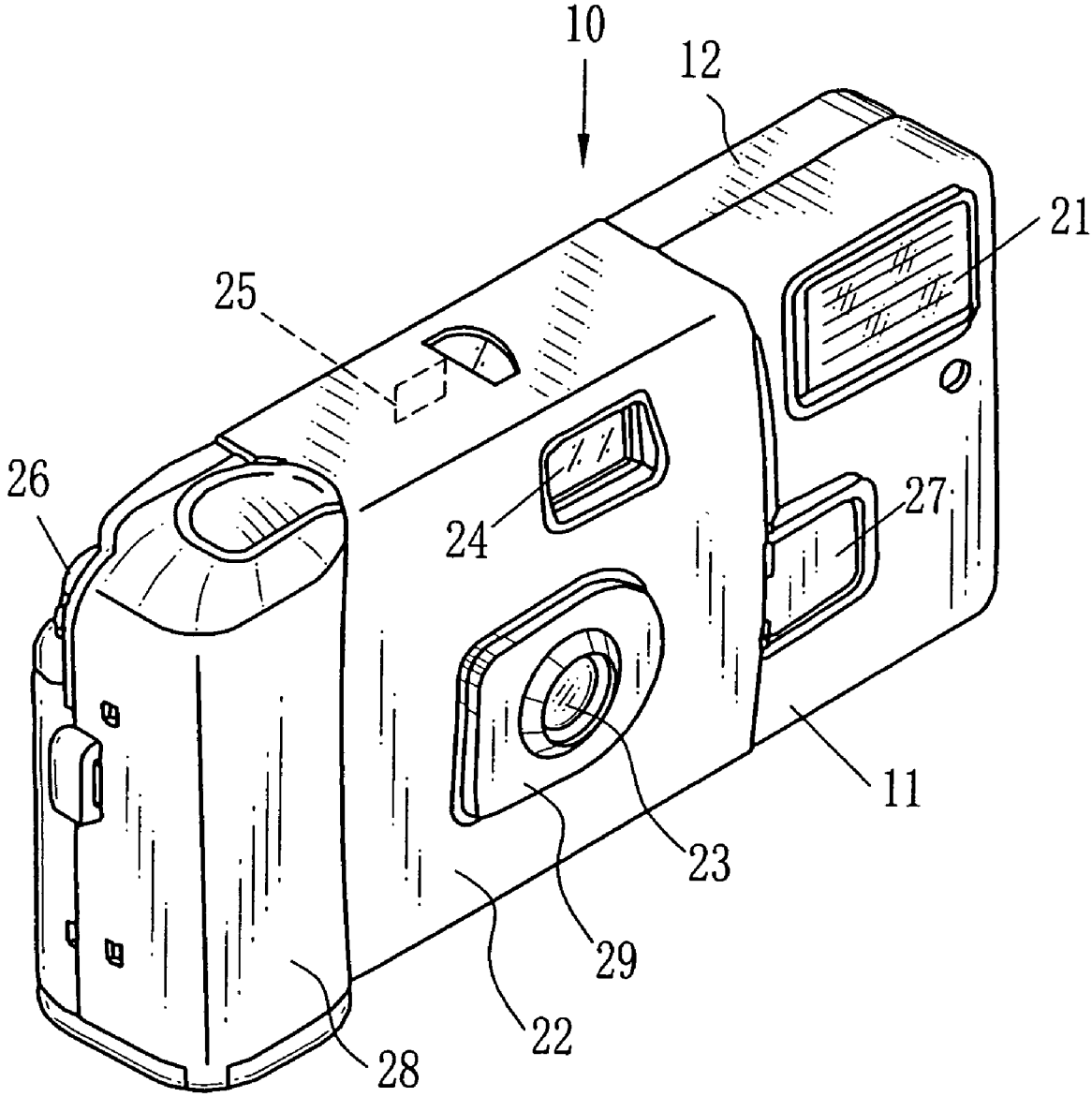
FIG. 2 is a front perspective view of the lens-fitted photo film unit.

As shown in FIG. 2, an ornamental outer casing 22, a label in this example, is put around the outer cover 11 and 12. The outer casing 22 may be a cardboard box. The outer casing 22 is formed with openings for exposing the photographic lens 23, a finder objective window 24 and a finder eyepiece window 25. A film winding wheel 26 partly protrudes from the rear cover portion 12. The flash emitting portion 21 and a flash charge button 27 are disposed on a front side of the film unit 10. Designated by 28 is a grip portion and 29 is a lens hood.

Figure 3:
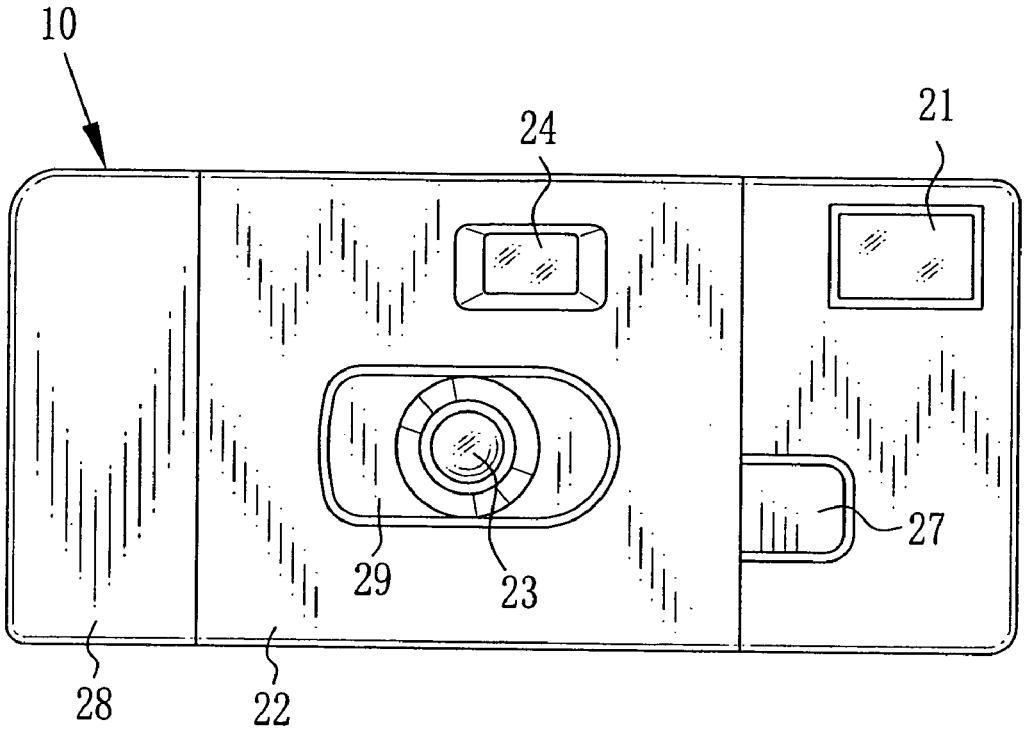
FIG. 3 is a front view of the lens-fitted photo film unit.
Figure 4:
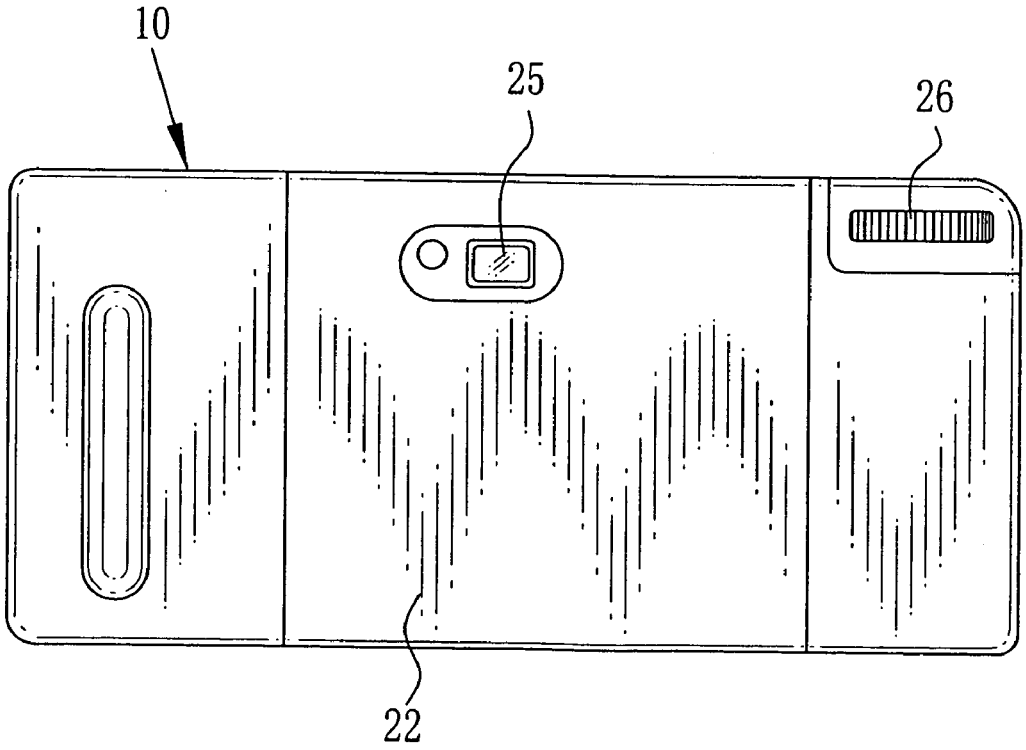
FIG. 4 is a rear side view of the lens-fitted photo film unit.

As well-known in the art, different types of film units are different in contour and appearance. As for the front side of the film unit 10, as shown in FIG. 3, the aspect ratio of the front side contour, i.e. the ratio of a vertical length to a horizontal length of the front side contour, is different from type to type. Also the grip portion 28 may have a different front contour and a different relative position to the front side contour of the film unit 10. The same applies to the lens hood 29, the finder objective window 24, the flash emitting portion 21 and the flash charge button 27. Although the film unit 10 is provided with the flash unit 16, there are such types of film units that have no flash device. In those cases, the flash emitting portion 21 and the flash charge button 27 do not exist. As for the rear side, as shown in FIG. 4, positions of the finder eyepiece window 25 and the film winding wheel 26 may differ from type to type. Correspondingly, positions of the internal components, including the metallic components, differ from type to type.

Figure 5:
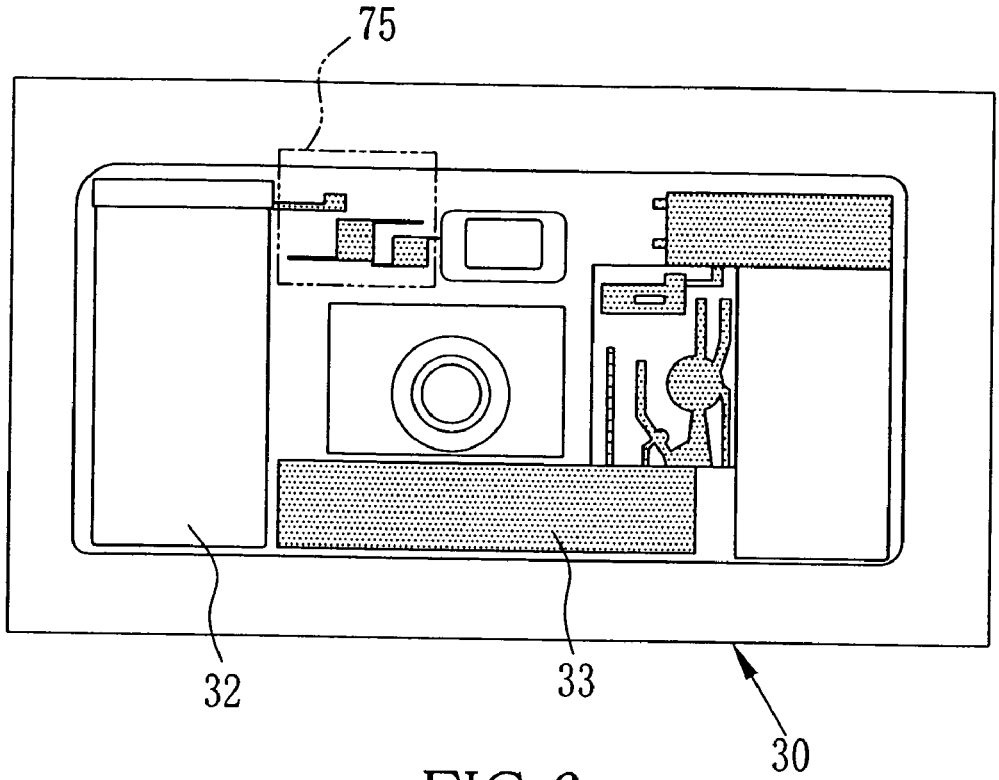
FIG. 5 is a schematic diagram illustrating an X-ray image of the lens-fitted photo film unit taken from the front.
Figure 6:
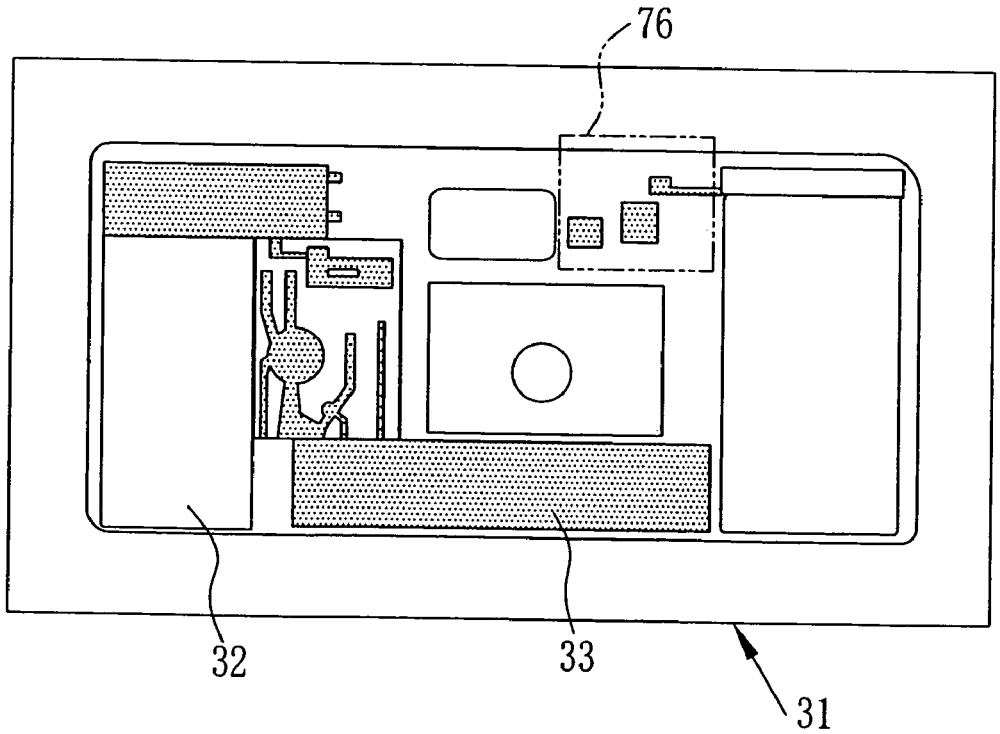
FIG. 6 is a schematic diagram illustrating an X-ray image of the lens-fitted photo film unit taken from the rear side.

Therefore, the positions of the internal metallic components of the individual film units can be utilized as features of the respective film unit types. According to a preferred embodiment, an X ray imaging device is adopted to take a transparent image of each film unit. Thereby, the type of each individual film unit may be determined on the basis of a transparent image alone that is taken either from the front side or from the rear side of the film unit. As described in detail later, the X ray imaging device takes a transparent image of the film unit. FIGS. 5 and 6 show transparent images 30 and 31 of the film unit 10, as taken from the front and rear sides respectively.

The transparent image is compared to a number of preset reference images, which have different patterns from each other to represent features of the respective types of film units. The comparison is carried out by a pattern matching method, wherein the transparent image is superposed on each reference image in a memory of an image processor, to check the correspondence between these two images.

Because the permeability to X-rays is different between plastics and metals, plastic components 32 of the film unit 10 are imaged to be white portions, while metallic components 33 are imaged to be black portions. Therefore, the black portions or the images of the metallic components 33 are used as the features of the respective film unit types. The transparent image 30 or 31 taken by the X ray imaging device is compared to the reference images of the respective film unit type, to select the most similar reference image to the transparent image 30 or 31. Then, the film unit 10 is determined to be of the type that is represented by the selected reference image.

Figure 7:
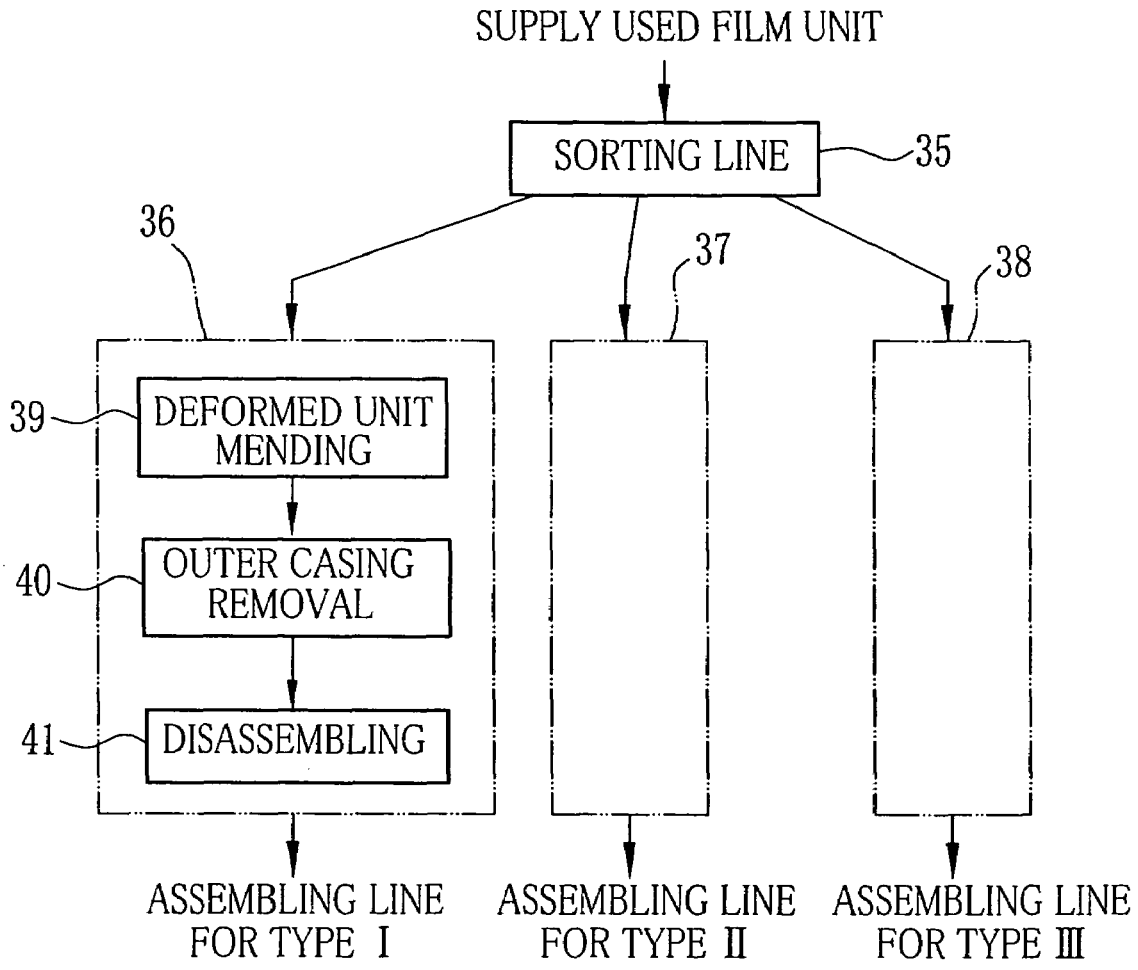
FIG. 7 is an explanatory diagram illustrating overall recycling processes of lens-fitted photo film units.

Referring to FIG. 7 illustrating overall recycling processes of film units, the film units after being used and separated from exposed photo film cartridges, are stocked in a container, and sent to the factory each time the stock of the used film units reaches a predetermined amount.

In the factory, the film units are sorted according to the types through a sorting line 35, and fed to disassembling lines 36, 37 and 38 of the corresponding types respectively. On each disassembling line 36, 37 or 38, the film units go through a deformed unit mending process 39 and an outer casing removal process 40 before a disassembling process 41. In the deformed unit mending process 39, the bottom lid 17 of each film unit is closed. As for such film unit whose bottom lid 17 cannot be closed, the bottom lid 17 is cut away. In the outer casing removal process 40, outer casings of the film units, including the labels 22 and cardboard boxes, are removed. In the disassembling process 41, the parts to reuse, such as the exposure unit 15 and the flash unit 16, are removed and inspected, before being fed to a corresponding assembling line.

Figure 8:
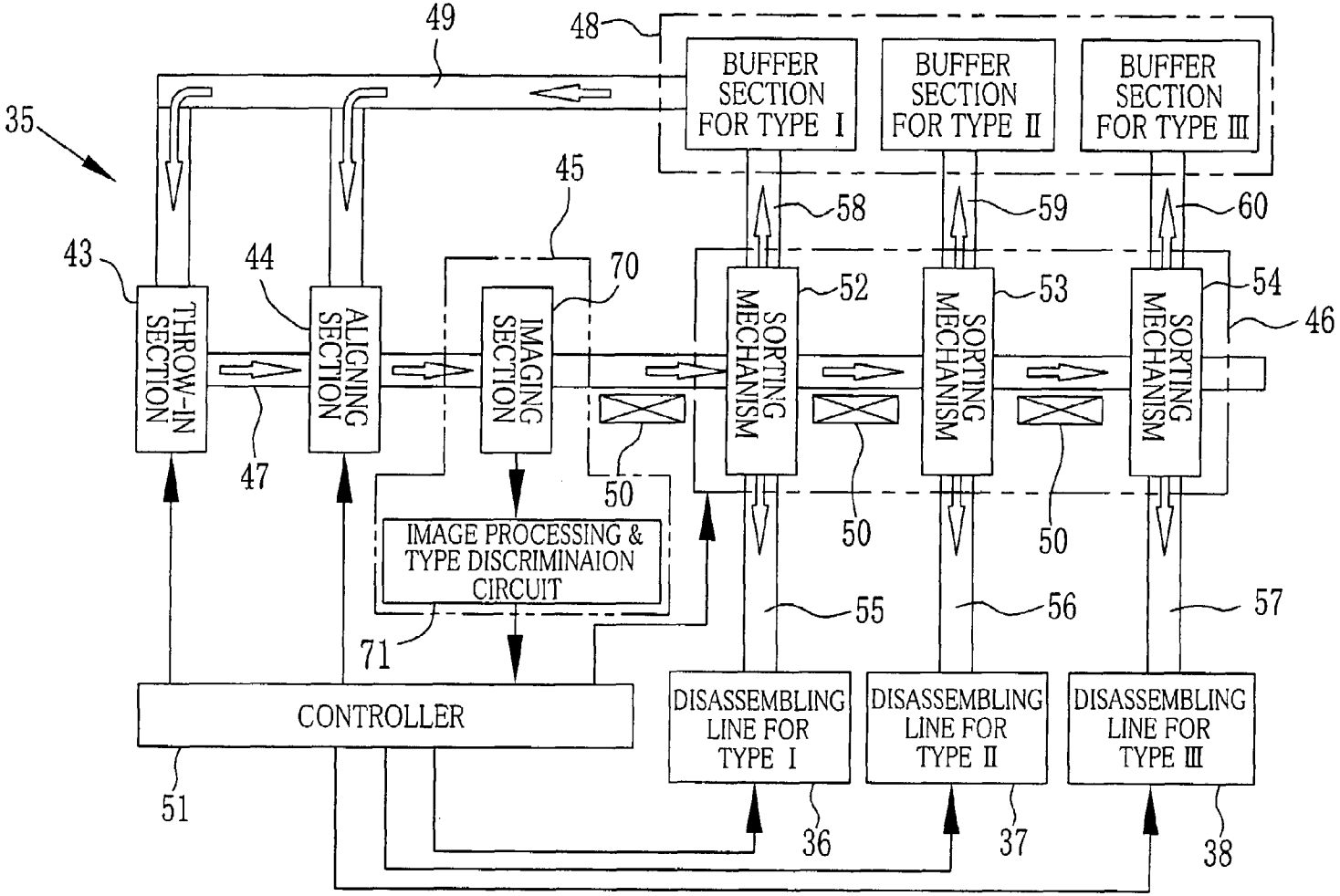
FIG. 8 is a block diagram illustrating a sorting line according to an embodiment of the invention.

As shown in FIG. 8, the sorting line 35 is mainly constituted of a throw-in section 43, an aligning section 44, a type discriminating section 45, a sorting section 46, a conveyer 47, buffer sections 48, a circulating conveyer 49, tracking sensors 50, and a controller 51. The conveyer 47 conveys film units in a forward direction. The throw-in section 43, the aligning section 44, the type discriminating section 45 and the sorting section 46 are arranged along the conveyer 47 in this order in the forward direction.

The throw-in section 43 is to supply randomly different types of film units in irregular postures onto the conveyer 47. The aligning section 44 aligns the conveyed film units such that every film unit directs its front or rear side upward, and is conveyed in a line with its lengthwise direction along the conveying direction and with spacing from one another.

The type discriminating section 45 detects the type of each individual film units, and outputs discrimination data to the controller 51.

The sorting section 46 is provided with a number of sorting mechanisms 52, 53 and 54, which are arranged sequentially along the conveying direction of the conveyer 47. Each of the sorting mechanisms 52, 53 and 54 sorts out film units of an individually predetermined type, e.g. type I, type II or type III respectively, and apportions the sorted film units between a supply line 55, 56 or 57 and a buffer line 58, 59 or 60 respectively. The supply lines 55 to 57 feed the film units to the disassembling lines 36 to 38 for the corresponding film unit types respectively. The butter lines 58 to 60 feed the film units to buffer sections 48 for the corresponding film unit types. Although there are three sorting mechanisms 52 to 54 in FIG. 8, the number of sorting mechanisms in the sorting section 46 varies depending upon the number of types of the film units to be recycled. The same applies to the supply lines 55 to 57, the disassembling lines 36 to 38, the buffer lines 58 to 60, and the buffer sections 48.

Figure 9:
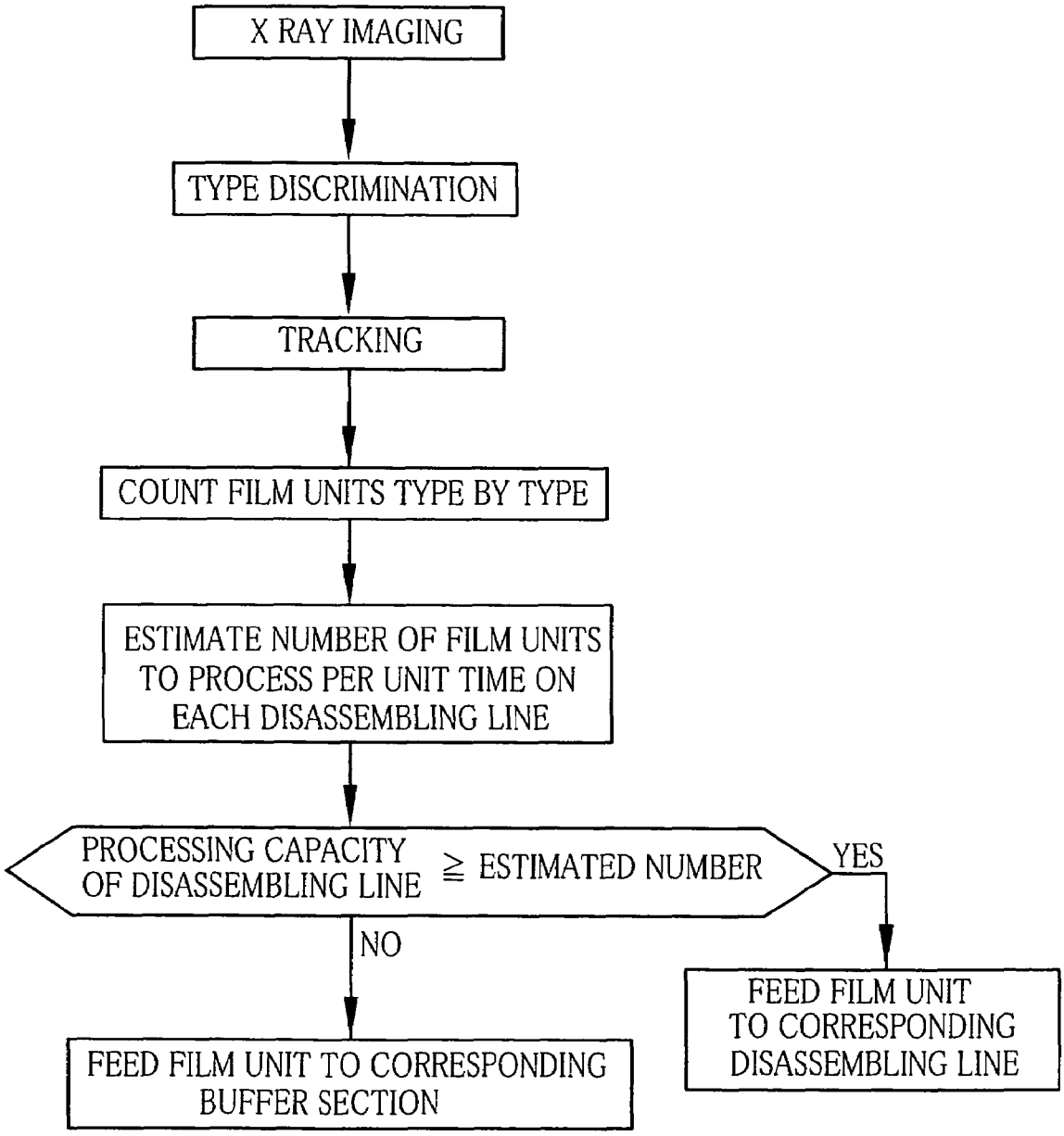
FIG. 9 is a flowchart illustrating a sequence of operations of a controller for the sorting line.

The controller 51 controls overall operations of the sorting line 35. As shown in FIG. 9, the controller 51 counts the number of discriminated film units separately from type to type, on the basis of the discrimination data from the discriminating section 45, and traces the discriminated film units through the tracking sensors 50, so as to drive the sorting mechanism 52, 53 or 54 each time the predetermined type film unit comes to the corresponding sorting mechanism 52, 53 or 54. Then the sorting mechanism 52, 53 or 54 takes and feeds the film unit either to the supply line 55, 56 or 57, or to the buffer line 58, 59 or 60.

Whether to feed the film units to the supply line or to the buffer line is determined depending upon how many film units of the same type has been supplied per unit time, i.e. the number of film units of the individual type as counted per unit time, in comparison with the number of film units processed per unit time through the disassembling line for the corresponding film unit type, i.e. the processing capacity of the individual disassembling line. The processing capacity of the individual disassembling line is predetermined for each type, while the number of film units supplied per unit time varies from type to type and from time to time as well.

For example, if the count per unit time is "10" with respect to the film units of type I, i.e. 10 pieces per minute (pieces/min.), while the predetermined processing capacity of the corresponding disassembling line 36 is 30 pieces/min., the controller 51 drives the sorting mechanism 52 to feed the film units of type I to the supply line 55. If, on the contrary, the count per minute of the film units of type I goes above 30, the controller 51 drives the sorting mechanism 52 to feed the film units of type I to the buffer line 58. Thereby, excessive supply of the film units to the disassembling lines 55 to 57 is prevented. If the count per unit time of the film units of one type is equal to the processing capacity of the corresponding disassembling line, the film units of this type may be feed to either one of the supply line and the buffer line.

Instead that the controller 51 counts the number of film units of each type on the basis of the discrimination data from the discriminating section 45, it is possible to count the number per unit time of film units that are actually fed to the individual disassembling line 36, 37 or 38. In that case, a sensor is disposed on each of the supply lines 55 to 57, to detect and count the film units as going by the sensor. Such a sensor may be disposed immediately behind each sorting mechanism 52, 53 or 54, or at the entrance of each disassembling line 36, 37 or 38.

Alternatively, the apportion at the individual sorting mechanism 52, 53 or 54 may be dependent upon how many film units are exiting on the corresponding supply line 55, 56 or 57, or how many film units the corresponding supply line 55, 56 or 57 can presently accept. The number of film units exiting on each supply line 55, 56 or 57 may be determined by subtracting the number of film units fed from each supply line 55, 56 or 57 to the corresponding disassembling line 36, 37 or 38, on one hand, from the number of film units fed from each of the sorting mechanisms 52 to 54 to the corresponding supply line 55, 56 or 57, on the other hand.

On the assumption that Nm represents the maximum number of film units capable of exiting stably on the individual supply line 55, 56 or 57, and Nt represents the number of film units actually existing on the individual supply line 55, 56 or 57, the controller 51 compares the number Nt with the maximum number Nm for each individual film unit type. If the number Nt is less than the maximum number Nm with respect to one type, the controller 51 judges that the disassembling line for this type can afford to process the film units, so the sorting mechanism 52, 53 or 54 for this type is driven to feed the film unit of this type to the corresponding supply line 55, 56 or 57. On the contrary, if the number Nt is more than the maximum number Nm with respect to one type, the corresponding sorting mechanism 52, 53 or 54 is driven to feed the film unit to the corresponding buffer line 58, 59 or 60.

The number of film units presently acceptable on the individual supply line 55, 56 or 57 is determined by subtracting the number Nt from the maximum number Nm. Therefore, it is possible to feed the film unit to the supply line 55, 56 or 57 when (Nm−Nt) is a positive value, or to the buffer line 58, 59 or 60 when (Nm−Nt) is zero or a negative value. To simplify the structure, it is possible to dispose a sensor for each of the supply lines 55 to 57 at a position to detect if the individual supply line is full, so as to feed the film unit to the corresponding buffer line when the supply line is full.

The tracking sensors 50 are disposed in association with the individual sorting mechanisms 52 to 54, to trace the respective film units by measuring the conveying amount of the conveyer 47 and detecting the film units one by one, as they go past the respective sorting mechanisms 52 to 54.

Since a set of the sorting mechanism, the supply line and the buffer line are provided for each film unit type, and these sets for the respective film unit types are arranged sequentially along the conveying direction of the conveyer 47, it is easy to add another set of sorting mechanism, supply line and buffer line for a new type of film unit.

The buffer sections 48 store the film units as fed through the buffer lines 58 to 60. In the illustrated embodiment, the buffer sections 48 are provided for respective film unit types, e.g. for type I, type II and type III, so as to store the film units separately from one type to another.

But it is possible that a buffer section stores the film units regardless of their type. In that case, the film units are automatically fed back to the throw-in section 43 through the circulating conveyer 49.

In the case where the film units are stored for each type in the respective buffer sections 48, the controller 51 drives only one of the buffer sections 48 at a time to feed back the stored film units of one type to the throw-in section 43 or the aligning section 44. The type of the film units to be fed back is determined with respect to the opening in the capacity of the disassembling lines 36 to 38 or that of the supply lines 55 to 57. That is, the film units of the individual type are fed back only while the disassembling line 36, 37 or 38 for that type or the corresponding supply line 55, 56 or 57 is available. Thereby, the amounts of the film units supplied to the respective disassembling lines 36 to 38 are balanced.

Figure 12:
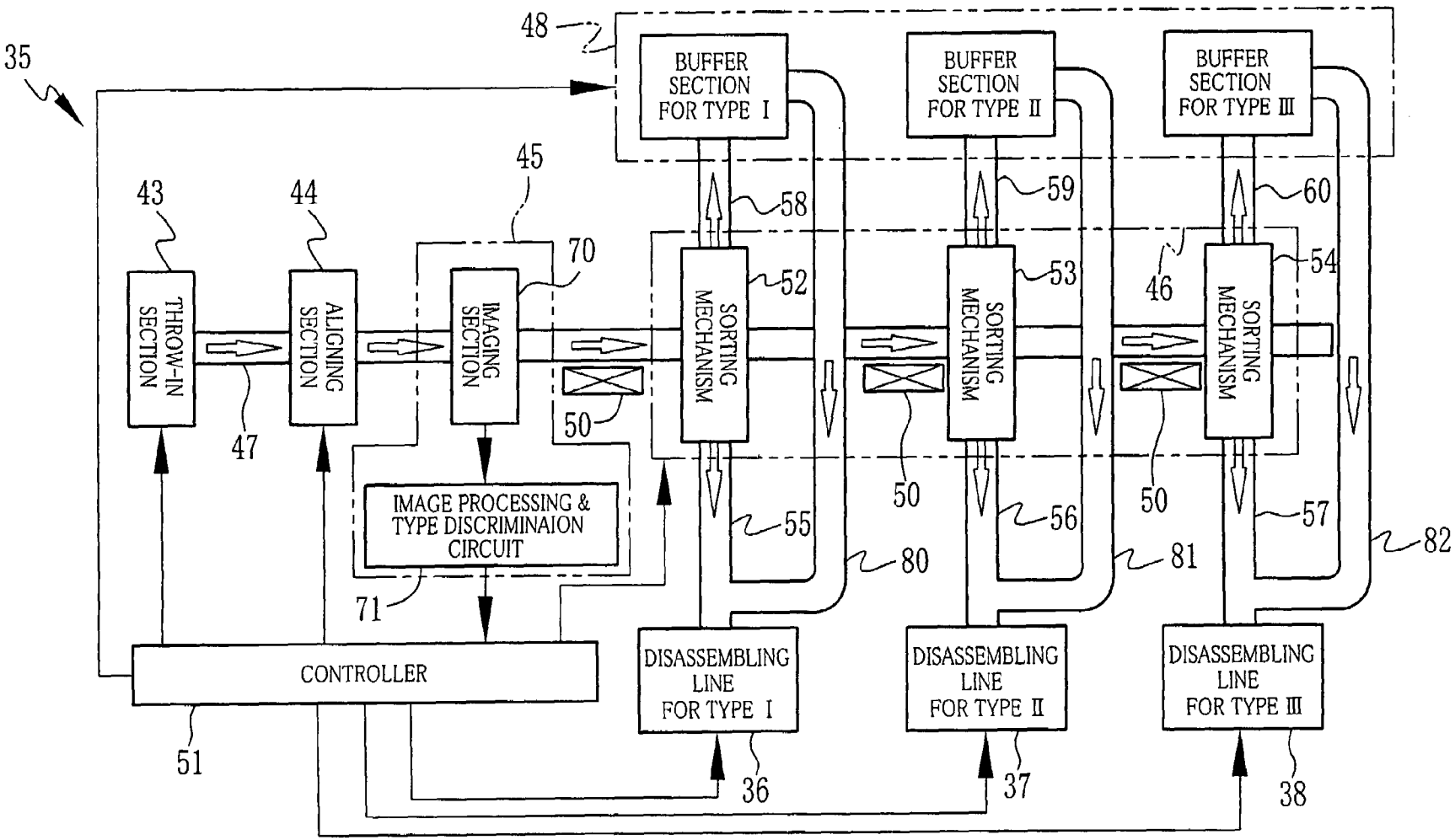
FIG. 12 is a block diagram illustrating a sorting line according to another embodiment of the invention.

It is alternatively possible to feed back the film units from the buffer sections 48 directly to the corresponding supply line 55, 56 or 57. In that case, as shown in FIG. 12, the buffer sections 48 are connected through respective supplemental conveyers 80, 81 and 82 to the supply lines 55 to 57 in one-to-one relationship in accordance with the film unit types. Under the control of the controller 51, the buffer sections 48 feed the film units through the supplemental conveyers 80 to 82 to the corresponding supply lines 55 to 57 when the corresponding disassembling lines 36 to 38 can afford to process the film units. According to this embodiment, the circulating conveyer 49 is unnecessary.

Now the type discriminating section 45 will be described in detail. The type discriminating section 45 is constituted of an imaging section 70 and an image processing and type determining circuit 71, which are controlled by the controller 51. The imaging section 70 mainly consists of an X ray irradiator and an imaging device, which are disposed stationary in opposition to each other across the conveying surface of the conveyer 47, so that the X ray irradiator applies the X-rays to the front side or the rear side of each individual film unit. Each time the film unit reaches an imaging field of the imaging section 70, which is detected by a sensor, the imaging section 70 starts imaging.

The X ray irradiator applies the X-rays to the film unit as it is conveyed. For example, the imaging device has a linear X ray sensor that outputs linear image data, or data of a line of pixels, each time the film unit is conveyed by a predetermined amount. The linear image data is accumulated in a memory of the imaging device in synchronism with the conveying speed of the film unit, so as to produce 2-dimensional image from the accumulated linear image data on the memory. The planer image data is transferred as a transparent image of the X rayed film unit to the image processing and type determining circuit 71. After each transfer of the 2-dimensional image, the memory of the imaging section 70 is cleared, and begins to accumulate the linear image data. As described above, the transparent image is a gray-scale image wherein the metallic components of the film unit look darker, while the plastic components look lighter.

The image processing and type determining circuit 71 is provided with an image processing circuit, a comparison circuit, ROM and RAM. The ROM or RAM stores the predetermined reference images for the respective film unit types. Each of the reference images represents a characteristic portion of a particular type film unit. Because the power source battery 19 and the flash emitting portion 21 are not so different in size and contour between the different film unit types, the characteristic portions are defined as those portions containing other metallic components, like the spring, having specific contour or size for each type. Take the film unit 10, for example, a portion 75 or 76 as shown in FIG. 5 or 6 is defined as the characteristic portion of the transparent image 30 or 31. For each individual type, the reference images of the front and rear sides are prepared. For some film unit types, a number of characteristic portions are predetermined within the reference image.

Figure 10:
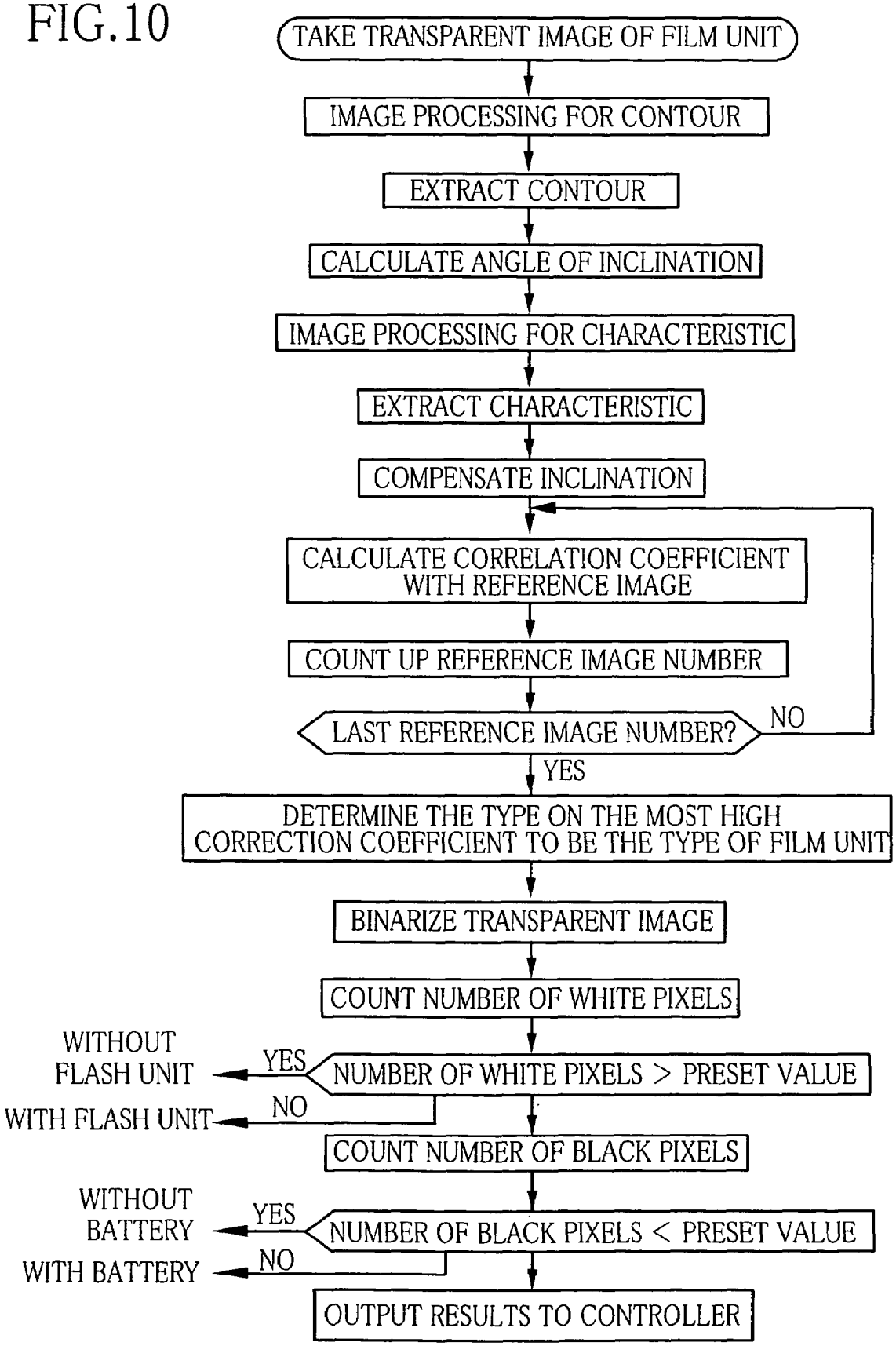
FIG. 10 is a flowchart illustrating a sequence of operations of an image processing and type discriminating circuit.

The transparent image is first subjected to a digital image processing to extract a contour of the film unit 10, as illustrated in the flowchart of FIG. 10. Then, an angle of inclination of the transparent image relative to the reference image, i.e. a rotational angle of the film unit about a vertical axis to the conveying surface, is calculated. Based on the calculated inclination, the direction of the transparent image is adjusted to the reference image.

Next, at least a characteristic portion of the transparent image is extracted through an image processing. The characteristic portion is automatically determined by position data stored in association with the reference image, the position data being representative of a relative position of the characteristic portion to the contour of the reference image.

The extracted characteristic portion or portions of the transparent image are individually compared with the corresponding characteristic portion or portions of the reference image of one film unit type. The comparison of the characteristic portion between the transparent image and the reference image is carried out from one type to another, so as to select the most similar reference image to the transparent image. Thus, the type of the film unit 10 as photographed is determined to be the film unit type represented by the most similar reference image. Furthermore, based on the most similar reference image, it is determined which side of the film unit 10, front side or rear side, is photographed.

Next, the transparent image is converted into binary data, and the number of white pixels within the contour is counted. As described above with respect to the film unit 10, most of the components of the flash unit 16, including the copper foil circuit pattern on the circuit board 18, the power source battery 19, the main capacitor 20 and the flash emitting portion 21, are metallic, so that they are represented by black pixels. Because they occupy a certain area within the contour, it is possible to determine based on the number of the white pixels within the contour, whether the photographed film unit contains a flash unit or not. If the count of the white pixels is more than a preset value, it is determined that the photographed film unit does not contain any flash unit, and thus any power source battery. If the count of the white pixels is less than the preset value, it is determined that the photographed film unit contains a flash unit.

Even if it is determined that the film unit contains the flash unit, there may be a case where the power source battery is illegally removed. In order to detect whether the film unit contains the power source battery or not, the number of black pixels within the contour is counted and compared with a second preset value. If the count of the black pixels is less than the second preset value, it is determined that the film unit does not contain any power source battery.

The image processing and type determining circuit 71 sends these discrimination data to the controller 51. The discrimination data include data of the film unit type, data as to whether the battery is contained or not, and data as to which side of the film unit is photographed. Concretely, as shown for example in FIG. 11, the discrimination data is sent as a discrimination result code in association with each individual film unit, and the discrimination result code consists of a two-digit code representative of a film type, a one-digit code representative of whether the battery is contained or not, and a one-digit code representative of the photographed side.

The controller 51 sends the discrimination data to the disassembling lines 36 to 38 in synchronism with the feeding of the film units to the respective disassembling lines 36 to 38. The discrimination data are utilized for aligning the film units into the same posture on the disassembling lines 36 to 38, as well as for determining the film units to be subjected to a process of removing the power source batteries on the disassembling lines 36 to 38. Thus, the discrimination data contribute to simplifying the disassembling processes and improving efficiency of disassembling.

Although the present invention has been described with respect to the illustrated embodiment, the present invention is not limited to the above embodiment.

For example, it is possible to photograph a surface image of each individual film unit by use of a solid state imaging device, like a CCD, instead of the X ray imaging device. In that case, the image is taken from one or each side of the individual film unit. Type discrimination of each film unit is carried out on the basis of positions and shapes of the respective features, including the grip portion 28, the photographic lens 23, the lens hood 29, the finder objective window 24, the flash emitting portion 21 and the flash charge button 27. For this purpose, the photographed image is processed into a density distribution pattern, an outline pattern and the like. These patterns are compared with reference image data that represent the characteristic features of the different film unit types.

As the method of discriminating the film unit type on the basis of the transparent image or the surface image, the above embodiment adopts the pattern matching method. Instead, it is possible to use another method, like a window setting method wherein a number of windows are placed at designated positions in a photographed image, and the number of white or black pixels is detected within each window, so as to determine the positions of the characteristic features in each image.

Although the above described embodiments relate to the method and apparatus for sorting the film units, the present invention is also applicable to sorting any other articles into a number of disassembling lines.

Thus, the present invention is not to be limited by the above description, but various modifications will be possible within the scope of the present invention as specified in the appended claims.

What is claimed is:

1. A sorting apparatus for sorting used articles according to their types, wherein said articles have different appearances or internal structures from type to type, said sorting apparatus comprising:

a conveyer for conveying said articles of different types in a conveying direction;

an imaging device for taking image data from each of said articles as being conveyed on said conveyer;

a discrimination device for determining the type of each of said articles on the basis of said image data, and outputting discrimination data for each article;

a sorting device disposed behind said imaging device in said conveying direction, for sorting said articles into individual types in accordance with said discrimination data;

a number of supply sections for supplying said articles, after being sorted, to a number of disassembling lines which are provided for the respective types of said articles;

a buffer section for storing said articles after being sorted; and a control device for controlling said sorting device such that each of said articles is fed from said sorting device through one of said supply sections to a corresponding one of said disassembling lines that is determined in accordance with the type of each article, only when it is determined that the corresponding disassembling line can afford to process said article, and that each of said articles is fed from said sorting device to said buffer section when it is determined that the corresponding disassembling line cannot afford to process said article.

2. A sorting apparatus as claimed in claim 1, wherein said control device counts the number of discriminated articles separately from type to type on the basis of said discrimination data, compares the count of each type per unit time with a preset number of articles processed per unit time on the corresponding disassembling line, and controls said sorting device to feed said article to said buffer section when the count per unit time is more than said preset number, or to the corresponding disassembling line when the count per unit time is less than said preset number.

3. A sorting apparatus as claimed in claim 1, wherein said control device monitors the number of said articles existing on each of said supply sections, and controls said sorting device to feed said article to said buffer section when the corresponding supply section cannot accept said article, or to the corresponding supply section when the corresponding supply section can accept said article.

4. A sorting apparatus as claimed in claim 1, further comprising a circulating device for feeding said articles from said buffer section back to said conveyer so that said articles are conveyed again through said imaging device to said sorting device.

5. A sorting apparatus as claimed in claim 1, wherein said buffer section consists of a number of buffer sections for storing said articles separately from type to type, and said sorting apparatus further comprises a number of supplemental lines connecting each of said buffer sections to a corresponding one of said supply sections, and wherein said controller controls each of said buffer sections to feed said article through said supplemental line to the corresponding supply section when the corresponding disassembling line can afford to process said article.

6. A sorting apparatus as claimed in claim 1, wherein said imaging device comprises an X ray imaging device that applies X-rays to a front side or a rear side of each of said articles to photograph a transparent image that shows an internal structure of each article, and said discrimination device determines the type of each article on the basis of said transparent image.

7. A sorting apparatus as claimed in claim 1, wherein said sorting device comprises a number of sorting mechanisms provided for the respective types of said articles, and said sorting mechanisms are arranged sequentially along said conveying direction, and are connected to said disassembling lines through said supply sections in one-to-one relationship.

8. A sorting apparatus as claimed in claim 7, wherein said buffer section consists of a number of buffer sections for storing said articles separately from type to type, and said sorting mechanisms are connected through respective buffer lines to said buffer sections.

9. A method of sorting used articles according to their types, wherein said articles have different appearances or internal structures from type to type, said method comprising the steps of:

conveying said articles of different types in a conveying direction;

taking image data from each of said articles as being conveyed;

determining the type of each of said articles on the basis of said image data, to output discrimination data for each article;

sorting said articles into individual types in accordance with said discrimination data;

monitoring the number of said articles separately from type to type, to check if each of disassembling lines, which are provided for the respective types of said articles, can afford to process said articles;

feeding each of said articles, after being sorted, to a corresponding one of said disassembling lines only when it is determined that the corresponding disassembling line can afford to process said article; and feeding said articles, after being sorted, to a buffer section when it is determined that the corresponding disassembling line cannot afford to process said article.

10. A sorting method as claimed in claim 9, wherein said monitoring step comprises the steps of:

counting the number of said articles separately from type to type; and comparing the count of each type per unit time with a preset number of articles processed per unit time on the corresponding disassembling line, wherein said article is fed to said buffer section when the count per unit time is more than said preset number, or to the corresponding disassembling line when the count per unit time is less than said preset number.

11. A sorting method as claimed in claim 10, wherein the number of said articles is counted for each type on the basis of said discrimination data.

12. A sorting method as claimed in claim 10, wherein the number of said articles is counted for each type as said articles are fed to the corresponding disassembling lines.

13. A sorting method as claimed in claim 9, wherein said articles are fed to the corresponding disassembling line through a corresponding one of supply lines that are provided for the respective types of said articles, wherein said monitoring step comprises the step of detecting the number of said articles presently existing on each of said supply lines to judge based on the existing number of said articles whether the corresponding supply line can further accept said article or not, and wherein said article is fed to said buffer section when the corresponding supply line cannot further accept said article, or to the corresponding supply line when the corresponding supply line can further accept said article.

14. A sorting method as claimed in claim 9, further comprising the step of feeding said articles from said buffer section back to an upstream of said conveying direction to feed said articles again through said imaging step to said sorting step.

15. A sorting method as claimed in claim 9, wherein said articles are stored separately from type to type in said buffer section, and are fed from said buffer section to the corresponding disassembling line when the corresponding disassembling line can afford to process said articles.

16. A sorting method as claimed in claim 9, wherein said image data is taken as a transparent image photographed from a front side or a rear side of each of said articles by use of an X ray imaging device.

17. A sorting apparatus for sorting articles according to their types, said articles having different appearances or internal structures from type to type, said sorting apparatus comprising:

a conveyer that conveys said articles in a conveying direction;

an imaging device that takes image data of each article being conveyed on said conveyer;

a discrimination device that determines the type of each article on the basis of said image data, and outputs discrimination data for each article;

a sorting device that sorts said articles into individual types in accordance with said discrimination data;

a plurality of supply sections that supply said articles, after being sorted, to a plurality of locations which are provided for the respective types of said articles;

a buffer section for storing said articles after being sorted; and a control circuit that controls said sorting device such that each of said articles is fed from said sorting device through one of said supply sections to a corresponding one of said locations that is determined in accordance with the type of each article, wherein said articles are sent to said buffer section when it is determined that said location corresponding to said article is not available to receive said article.

18. A method of sorting used articles according to their types, said articles having different appearances or internal structures from type to type, said method comprising:

conveying said articles in a conveying direction;

taking image data of each article being conveyed;

determining the type of each article on the basis of said image data in order to output discrimination data for each article;

sorting said articles into individual types in accordance with said discrimination data;

conveying each article, after being sorted, to one of a plurality of supply sections corresponding to said type of said article, said supply sections respectively supplying a plurality of locations which are provided for the respective types of said articles, wherein said articles are conveyed to a buffer section when it is determined that said location corresponding to said article is not available to receive said article.

19. The sorting apparatus of claim 1, wherein said article is a camera and said type is a type of film unit disposed in said camera.

20. The sorting method of claim 9, wherein said article is a camera and said type is a type of film unit disposed in said camera.

21. The sorting apparatus of claim 17, wherein said article is a camera and said type is a type of film unit disposed in said camera.

22. The sorting method of claim 18, wherein said article is a camera and said type is a type of film unit disposed in said camera.

* * * * *